US007544009B2

(12) United States Patent
Bergendahl et al.

(10) Patent No.: US 7,544,009 B2
(45) Date of Patent: Jun. 9, 2009

(54) COMBINED GUARDRAIL AND CABLE SAFETY SYSTEMS

(75) Inventors: Peter Bergendahl, Ängelholm (SE); Don J. Gripne, Olympia, WA (US); Chuck Norton, Farmington, UT (US); Elzard Sikkema, Murray, UT (US)

(73) Assignee: Trinity Industries, Inc., Dallas, TX (US)

( * ) Notice: Subject to any disclaimer, the term of this patent is extended or adjusted under 35 U.S.C. 154(b) by 0 days.

(21) Appl. No.: 11/398,115

(22) Filed: Apr. 5, 2006

(65) Prior Publication Data

US 2006/0182495 A1 Aug. 17, 2006

Related U.S. Application Data

(62) Division of application No. 10/975,756, filed on Oct. 28, 2004, now Pat. No. 7,249,908.

(51) Int. Cl.
*E01D 15/00* (2006.01)

(52) U.S. Cl. ..... 404/6; 256/13.1

(58) Field of Classification Search ..... 404/6; 256/13.1

See application file for complete search history.

(56) References Cited

U.S. PATENT DOCUMENTS

| | | | | |
|---|---|---|---|---|
| 2,005,418 | A | 6/1935 | Gleason et al. | 256/13.1 |
| 2,168,930 | A | 8/1939 | Bradshaw | 256/13.1 |
| 2,265,698 | A | 12/1941 | Opgenorth | 256/13.1 |
| RE22,060 | E | 4/1942 | Hayden et al. | 256/13.1 |
| 2,317,248 | A | 4/1943 | Brickman | 256/13.1 |
| 2,907,552 | A | 10/1959 | Crone | 256/13.1 |
| 3,317,189 | A | 5/1967 | Rubenstein | 256/13.1 |
| 3,865,349 | A | 2/1975 | Leiblich | 256/47 |
| 4,075,473 | A | 2/1978 | Winston | 256/13.1 |
| 4,501,411 | A | 2/1985 | Otaki | 256/13.1 |
| 4,623,127 | A | 11/1986 | Wier | 256/35 |

(Continued)

FOREIGN PATENT DOCUMENTS

| | | |
|---|---|---|
| EP | 369659 | 11/1989 |

(Continued)

OTHER PUBLICATIONS

Cable Guardrail Anchor Post Drawing, PSE06, 2 pgs, 1994.

(Continued)

*Primary Examiner*—Gary S Hartmann
(74) *Attorney, Agent, or Firm*—Baker Botts L.L.P.

(57) ABSTRACT

A combined guardrail and cable safety system is disclosed. In one aspect, the present invention teaches a safety barrier including a plurality of cable posts spaced from each other and disposed adjacent to a roadway. At least two cables are releasably engaged with and supported by the cable posts. The cable posts and the two cables cooperate with each other to prevent a vehicle from leaving the roadway. A plurality of guardrail posts are spaced from each other and disposed adjacent to the roadway longitudinally spaced from the plurality of cable post. A guardrail beam is fixedly coupled to the plurality of guardrail posts and including slots. The two cables extend from the cable posts through respective slots formed in the guardrail beam permitting each cable to engage a respective cable anchor bracket securely fastened to a portion of the guardrail beam.

10 Claims, 9 Drawing Sheets

U.S. PATENT DOCUMENTS

| | | | | | |
|---|---|---|---|---|---|
| 5,039,066 | A | | 8/1991 | Stacey | 256/13.1 |
| 5,876,020 | A | | 3/1999 | Giavotto | 256/13.1 |
| 5,967,497 | A | * | 10/1999 | Denman et al. | 256/13.1 |
| 6,065,738 | A | | 5/2000 | Pearce et al. | 256/13.1 |
| 6,129,342 | A | * | 10/2000 | Bronstad | 256/13.1 |
| 6,142,452 | A | * | 11/2000 | Denman et al. | 256/13.1 |
| 6,173,943 | B1 | * | 1/2001 | Welch et al. | 256/13.1 |
| 6,190,085 | B1 | | 2/2001 | Johansson | 404/6 |
| 6,854,716 | B2 | * | 2/2005 | Bronstad | 256/13.1 |
| 6,962,328 | B2 | | 11/2005 | Bergendahl | 256/13.1 |
| 7,059,590 | B2 | * | 6/2006 | Bronstad | 256/13.1 |
| 7,182,320 | B2 | * | 2/2007 | Heimbecker et al. | 256/13.1 |
| 7,249,908 | B2 | | 7/2007 | Bergendahl et al. | 404/6 |
| 2002/0014620 | A1 | | 2/2002 | Nilsson | 256/59 |
| 2002/0185639 | A1 | | 12/2002 | Galivan | 256/32 |
| 2003/0222254 | A1 | | 12/2003 | Bergendahl | 256/13.1 |
| 2004/0140460 | A1 | | 7/2004 | Heimbecker et al. | 256/13.1 |
| 2005/0077507 | A1 | | 4/2005 | Heimbecker et al. | 256/13.1 |
| 2007/0102689 | A1 | | 5/2007 | Alberson et al. | 256/13.1 |

FOREIGN PATENT DOCUMENTS

| | | | |
|---|---|---|---|
| EP | 845558 | | 6/1997 |
| EP | 1213391 | A2 | 6/2002 |
| FR | 2735164 | | 12/1996 |
| GB | 1012212 | | 12/1965 |
| GB | 2224529 | A | 5/1990 |
| WO | 3098086 | | 11/2003 |
| WO | 2005028757 | | 3/2005 |

OTHER PUBLICATIONS

PCT International Search Report, PCT/US2005/035669, 11 pages, Apr. 10, 2005.
CL 972-99, Memoria Descriptiva, 7 pages, Jun. 6, 1995.
PCT International Search Report w/Written Opinion PCT/US03/16414, 4 pages, Nov. 14, 2005.
Letter dated Aug. 30, 2002 from Carol H. Jacoby, Director, Office of Safety Design to Mr. Rick Mauer at Marion Steel Company. 5 Pages.
Trinity Industries Inc.'s, CASS Cable Safety System Brochure distributed Nov. 2002. 4 Pages.
PCT International Search Report, PCT/US03/16414, 4 pages, Apr. 5, 2006.
Letter dated Nov. 17, 2005, from U.S. Department of Transportation, Federal Highway Administration, in reply refer to: HSA-10/B-141, 10 pgs.
Letter dated Sep. 9, 2005, from U.S. Department of Transportation, Federal Highway Administration, in reply refer to: HSA-10/B-137A, 4 pgs.
Letter dated Jun. 13, 2005, from U.S. Department of Transportation, Federal Highway Administration, in reply refer to: HSA-10/B-137, 6 pgs.
Letter dated Aug. 28, 2003, from U.S. Department of Transportation, Federal Highway Administration, in reply refer to: HSA-10/B-119B, 3 pgs.
Letter dated May 15, 2003, from U.S. Department of Transportation, Federal Highway Administration, in reply refer to: HSA-10/B-119, 8 pgs.
Letter dated May 26, 2005, from U.S. Department of Transportation, Federal Highway Adminstration, in reply refer to: HSA-10/B-88C, 3 pgs.
Letter dated May 26, 2005, from U.S. Department of Transportation, Federal Highway Administration, in reply refer to: HSA-10/B-88C, 3 pgs.
Chilean Search Report Patent Application N 1089-03, 3 pages.
Letter dated Oct. 12, 2005. from U.S. Department of Transportation, Federal Highway Administration, in reply refer to: HSA-10/B-96A, 4 pgs.

* cited by examiner

COMBINED GUARDRAIL AND CABLE SAFETY SYSTEMS

RELATED APPLICATION

This application is a divisional of U.S. patent application Ser. No. 10/975,756 entitled "Combined Guardrail and Cable Safety Systems" filed Oct. 28, 2004 now U.S. Pat. No. 7,249,908.

TECHNICAL FIELD

The present invention is related to highway barriers and safety systems and more particularly to combined guardrail and cable safety systems and associated posts.

BACKGROUND OF THE INVENTION

Guardrails are traffic barriers placed along roadsides to screen arrant vehicles from hazards behind the barrier. A common guardrail in the U.S. is constructed using a standard steel W-beam mounted on spaced wood or steel posts. Because the W-beam functions primarily in tension when redirecting impacting vehicles, a function of the end is to provide necessary anchorage for the beam to develop necessary tensile forces. In addition, since the guardrail end represents a discontinuity in the barrier system, it is subject to being struck "head-on" by vehicles with small departure angles from the roadway. When struck in this manner, the end might spear the vehicle. Some widely used terminal designs "bury" the W-beam at the end to eliminate spearing, but this design may have shortcomings, including causing problems related to vaulting and rollover due to the vehicle riding up the end, and subsequently becoming airborne.

Another type of highway safety device are cable safety systems and cable barriers, which have been installed along edges of roadways and highways for many years. Cable safety systems and cable barriers have also been installed along medians between roadways and/or highways. Cable safety systems generally include one or more horizontal cables attached to support posts. For some applications cable safety systems and cable barriers may reduce damage to an impacting vehicle and/or injury to occupants of the impacting vehicle as compared with other types of highway safety systems and highway barriers.

Cable safety systems are often designed and installed with at least one cable mounted horizontally on a plurality of generally vertical support posts. The number of cables may vary depending on various factors such as the type of vehicles using the associated roadway and the hazard which required installation of the cable safety system. The length of a cable safety system is generally determined based on the adjacent roadside hazard. Each cable is typically installed at a selected height relative to the ground and with selected vertical spacing between adjacent cables. Associated support posts are installed with desired horizontal spacing between adjacent posts.

One recognized limitation of many cable safety systems is excessive deflection of associated cables during a vehicle impact. Deflection associated with a cable safety system may be larger than deflection of a convention W-beam guardrail when subjected to the same type of vehicle impact. Such deflection frequently determines maximum allowed spacing between adjacent posts for satisfactory performance of the cable safety system. Large deflection during a vehicle impact also increases the risk of the vehicle running over the cables and being exposed to the hazard, which required installation of the cable safety system. Calculating performance of many cable safety systems is often difficult due to unpredictable interactions between associated posts and cables during a vehicle impact. Depending upon car type, speed and angle of impact, cables may release as far as ten (10) or most posts spaced ahead of the impact location. Cable release from posts often causes much larger deflections than expected or calculated.

From full scale crash testing and from real life experience, it has been determined that keeping the length of unsupported cables as short as possible will generally reduce deflection. The longer the distance between adjacent posts supporting associated cables, the larger the deflection will generally be during a vehicle impact. An increased number of posts (shorter post spacing) will generally decrease deflection. However, shorter spacing between posts affects total cost of a cable safety system, not only material, but also installation cost.

During the past several years, cable safety systems have been used as an alternative to traditional W-beam guardrail systems. These cable safety systems address some of the weaknesses of prior cable safety systems by using prestretched cables and/or reducing spacing between adjacent posts to reduce deflection to an acceptable level. A consultant report "Dynamic Analysis of Cable Guardrail" issued in Apr. 1994 by an ES-Consult in Denmark, established a model for various parameters, which affect performance and design considerations for acceptable deflection of cable safety systems.

Standards have been developed within the European standardization body, CEN (Commite Europeen de Normalisation), for impact tests performed on safety systems and barriers. These barrier impact tests are described in CEN 1317, Road Restraint Systems. According to the CEN standards, safety systems and barriers are to be impact tested at different containment levels. The elongation or deformation of a barrier is also measured to determine a safe working width. The environment in which the barrier is to be constructed generally determines appropriate containment level as well as permissible working width. The CEN standard generally requires that the risk of injury in a collision with the barrier is minimized (injury risk class). CEN standards are used in the European countries and several countries near Europe, among others.

NCHRP stands for the National Cooperative Highway Research Program, a program developed by the Transportation Research Board of the National Research Council, USA. Report 350 is entitled "Recommended Procedures for the Safety Performance Evaluation of Highway Features" and may be commonly referred to as the NCHRP 350 Standard. The standard describes how impact tests should be conducted. Test results may be used to determine elongation or deformation and safe working widths. This standard is used mainly in the USA and is predominately used in Australia and New Zealand.

SUMMARY OF THE INVENTION

In accordance with teachings of the present invention, a combined guardrail and cable safety system is provided which overcomes many disadvantages and problems associated with prior guardrail safety systems, cable safety systems and cable barriers.

A safety barrier incorporating teachings of the present invention may include a plurality of cable posts spaced from each other and disposed adjacent to a roadway. At least two cables may be releasably engaged with and supported by the cable posts. The cable posts and the at least two cables cooperate with each other to prevent a vehicle from leaving the roadway. A plurality of guardrail posts may also be spaced from each other and disposed adjacent to the roadway longitudinally spaced from the plurality of cable post. A guardrail beam may be coupled to the plurality of guardrail posts. The at least two cables preferably extend from the cable posts to engage respective cable anchor brackets attached to portions of the guardrail beam.

For some embodiments, a combined guardrail and cable safety system may include a guardrail safety system extending along a roadway. The guardrail safety system may have a plurality of guardrail posts. Each guardrail post may be operably coupled to a longitudinally corrugated guardrail beam having at least two crowns and a valley disposed between the crowns. One or more cables may extend from a cable safety system such that the one or more cable may be received at the guardrail beam and traverses within the valley of the guardrail beam. An elongated slot may be disposed in and extend longitudinally along the guardrail beam. The slot may be sized to receive a portion of the one or more cables therethrough. A cable anchor bracket may be fastened to a portion of the guardrail safety system. The cable anchor bracket may be operable to receive and secure the portion of each of the one or more cables protruding through the slot such that sufficient tension is applied to the respective cable.

In further embodiments, a guardrail beam having a cable anchor assembly for joining a guardrail safety system to a cable safety system may include a longitudinally corrugated rail having a W beam configuration defined in part by a valley disposed between two crowns. The beam may be operably coupled to a plurality of support posts that extend along a roadway. The valley includes an elongated opening extending longitudinally along the valley such that the opening receives a cable extending from the cable safety system formed adjacent the guardrail safety system along the roadway wherein one end of the guardrail system is contiguous with one end of the cable system. A cable anchor assembly having a cable anchor bracket secured to a portion of the beam adjacent to the opening. The cable anchor bracket operable to receive an end portion of the cable such that the cable may be secured to the beam.

Technical benefits of the present invention include providing a combined guardrail and cable safety system that maintains adequate barrier protection during a transition between cable and guardrail safety systems. Because the cables may be coupled directly to associated guardrail beams, the cable will have adequate tension adjacent to the junction between the cable system and the guardrail system. Additionally, attaching the cables directly to the beams will transfer forces from an impacting vehicle to both the cable safety system and the guardrail safety system.

Additional technical benefits of the present invention include a combined guardrail and cable safety system that has cables with less tension and greater spacing between associated support posts. Due to the transition between the cable safety system and the guardrail safety system, the combined guardrail and cable safety system maintains satisfactory deflecting characteristics.

Further technical benefits of the present invention include an economical design and the employment of component parts. Repairs or replacement of damaged components may often be more easily accomplished after a vehicle impact due to each component's design. The need for periodic re-tensioning of cables may be reduced or eliminated by the present invention.

Further technical benefits of the present invention include a flexible transition junction between a guardrail safety system and cable safety system. Because cables extending from the cable safety system may be attached with associated guardrail beams, a smoother transition is possible from the cable the system to the guardrail safety system. Thus, designers have more flexibility in design and installation of cable and/or guardrail safety systems as determined by specific highway and roadway conditions.

The present invention allows differences in design and performance of cable and guardrail safety systems to be combined into an appropriate safety system for a wide variety of highways and roadways. The present invention provides a smooth transition between a cable safety system and a guardrail safety system. The present invention provides a combination of guardrail and cable safety system designs which assists in joining or bridging the two safety systems.

All, some, or none of these technical advantages may be present in various embodiments of the present invention. Other technical advantages will be apparent to one skilled in the art from the following figures, descriptions, and claims.

BRIEF DESCRIPTION OF THE DRAWINGS

A more complete and thorough understanding of the present invention and advantages thereof may be acquired by referring to the following description taken in conjunction with the accompanying drawings, in which like reference numbers indicate like features, and wherein.

DETAILED DESCRIPTION OF THE INVENTION

Preferred embodiments of the invention and its advantages are best understood by reference to FIGS. 1 through 14 wherein like reference numbers indicate like features.

The terms "safety system" or "safety systems" and "barrier" or "barriers" may be used throughout this application to include any type of safety system and/or barrier which may be formed at least in part using cables, guardrails and support posts incorporating teachings of the present invention. The term "roadway" may be used throughout this application to include any highway, roadway or path satisfactory for vehicle traffic. Safety systems and barriers incorporating teachings of the present invention may be installed in median strips or along shoulders of highways, roadways or any other path which is likely to encounter vehicular traffic.

Various aspects of the present invention will be described with respect to combined guardrail and cable safety systems 15. However, teachings of the present invention may be used to form a wide variety of safety systems and barriers.

Figure 1:
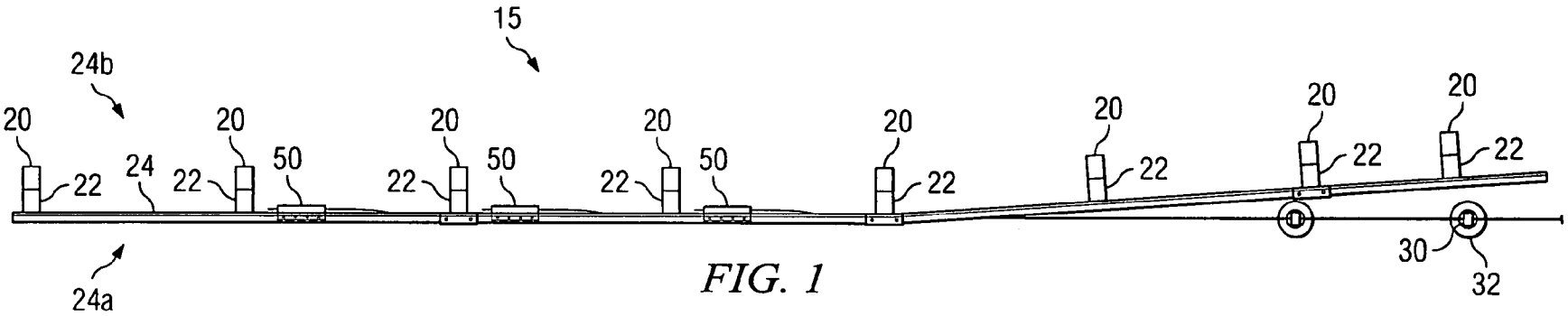
FIG. 1 illustrates a plan view of one embodiment of a combined guardrail and cable safety system incorporating teachings of the present invention.
Figure 2:
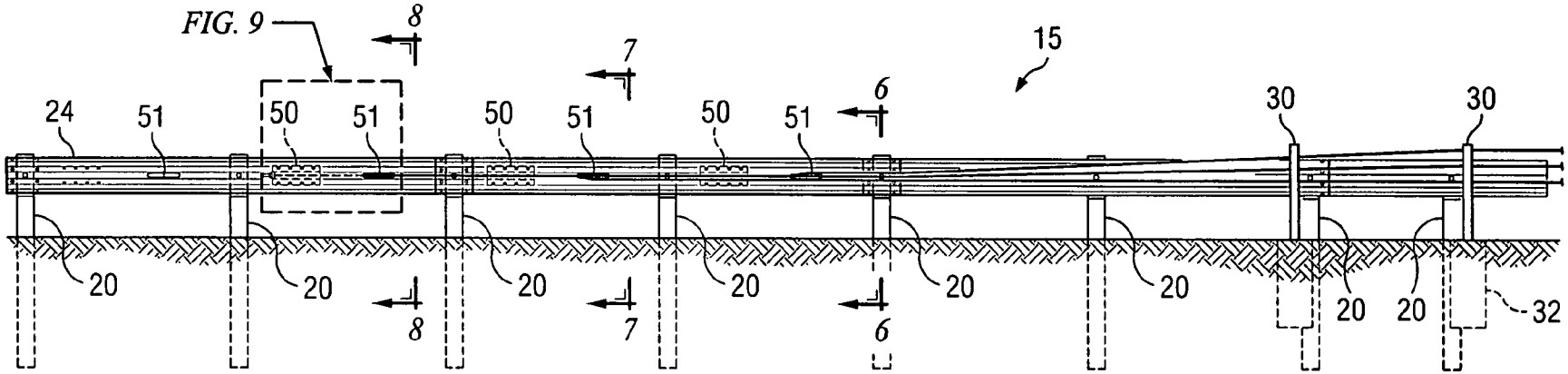
FIG. 2 is a schematic drawing in elevation of the combined guardrail and cable safety system of FIG. 1.

Referring to FIGS. 1 and 2, combined guardrail and cable safety systems 15 may be installed adjacent to a roadway (not expressly shown) to prevent motor vehicles (not expressly shown) from leaving the roadway and to redirect vehicles away from hazardous areas without causing serious injuries to the vehicle's occupants or other motorists.

Combined guardrail and cable safety system 15 may be satisfactorily used as a median, a single barrier installation along the edge of a roadway and at merge applications between adjacent roadways. For some applications, combined guardrail and cable safety systems 15 may satisfactorily withstand a second impact before repairs have been made after a first impact. For many applications, combined guardrail and cable safety systems 15 may be described as generally maintenance free except for repairs required after a vehicle impact.

Combined guardrail and cable safety system 15 typically includes a plurality of support posts for cables, namely cable posts 30, and support post for guardrail beams, namely posts 20, that are anchored adjacent to the roadway. Posts 20 and 30 may be anchored with the ground using various techniques. As shown in one example embodiment, concrete foundation 32 may be provided with holes to allow relatively quick and easy insertion and removal of cable posts 30. The number, size, shape and configuration of posts 20 and 30 may be significantly modified within teachings of the present invention. Optimum spacing between posts 20 and 30 may be designed in accordance with teachings of the present invention.

Guardrail beams 24 are preferably mounted on a plurality of posts 20 using bolt 23. Posts 20 are preferably made from wood, metal or other suitable types of material satisfactory for highway safety systems. The types of material which may be satisfactorily used to manufacture posts with the desired strength and/or breakaway characteristics appropriate for a specific guardrail system, location of each post and roadside hazard include, but are not limited to, wood, metal (e.g., steel), composite materials and other various types of plastics.

In some embodiments, guardrail post 20 includes a weak-post W-beam guardrail. The weak-post W-beam guardrail preferably mounts directly into the soil and may include a soil plate. Typically, the weak-post includes an I-beam shaped structural steel member having an "I" shape formed by a web portion interposed between two flange portions that are arranged substantially parallel to each other. Generally, the I-beam is preferably arranged with the flange portions facing and extending parallel to the roadway or highway. Guardrail beams 24 such as a W-beam may couple to a flange portion of one or more I-beam member to extend along roadway. Typically, guardrail beams 24 couple directly to the I-beam members but may also include a block out structure such as block out 22 disposed between the I-beam member and guardrail beam 24.

In one particular application, posts 20 may be installed in foundation tubes (not shown). Other applications, for example in flared end terminals, two (2) posts 20 are normally installed in the foundation tubes. The remaining posts may be installed adjacent to the highway without the use of any foundation tubes as such they are buried directly in the ground.

Typically, posts 20 are connected to guardrail beam 24 adjacent to the roadway facing the oncoming traffic. Generally, block out 22 is preferably disposed between post 20 and guardrail beam 24, however, in some instances block outs 22 are not used.

Guardrail beam 24 of the present invention preferably includes an elongated slot 51 disposed or formed in beam 24 such as in a W-beam guardrail. In some embodiments, a series of slots 51 are longitudinally spaced along the rail. Generally, it is preferred that each slot 51 be approximately centered or placed at one-third distance points between post 20. In other embodiments, it is preferred that each slot 51 is centered approximately at one-third distance points between post 20.

Figure 6:
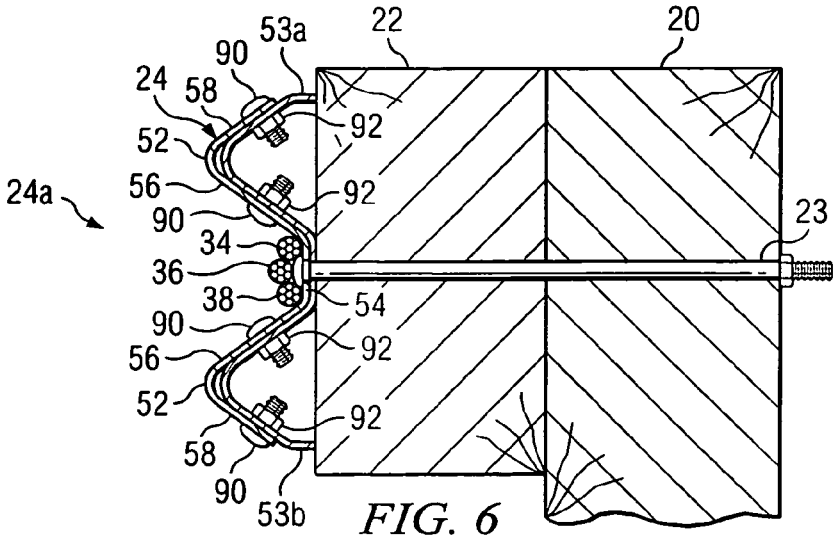
FIG. 6 is a schematic drawing taken along lines 6-6 of FIG. 2.
Figure 7:
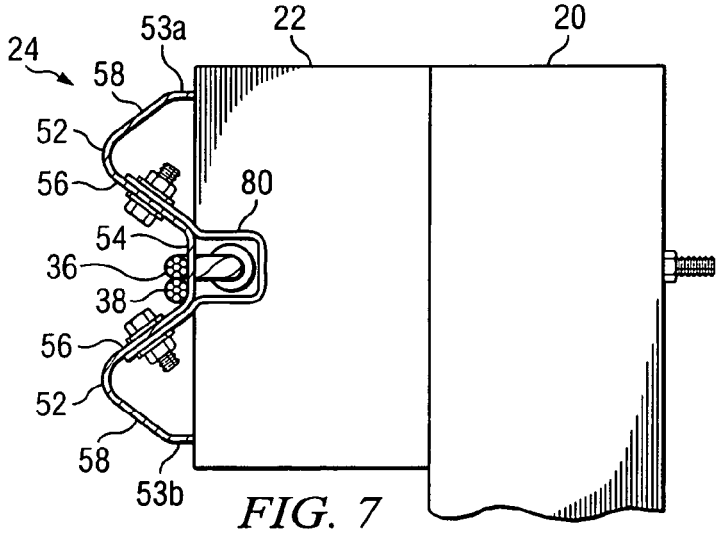
FIG. 7 is a schematic drawing taken along lines 7-7 of FIG. 2.
Figure 8:
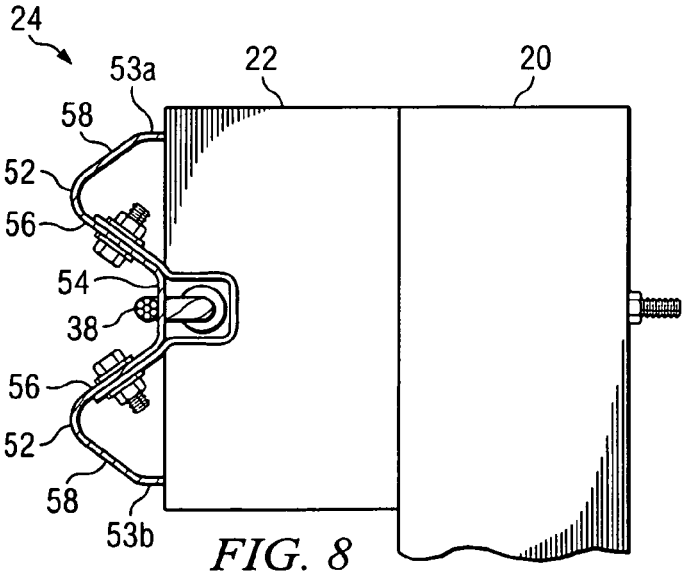
FIG. 8 is a schematic drawing taken along lines 8-8 of FIG. 2.

A preferred placement of slot 51 is better understood with reference to the cross-section for a typical guardrail beam 24 as shown in FIGS. 6-8. A valley 54 is positioned between peaks or crowns 52 and is formed at the intersections of inclined web portions 56. Edge members 58 laterally outline each crown 52. Highly preferred placement for slots 51 is proximate each crown 52 and the valley 54. The slots 51 should be of a size sufficient to reduce the ability of the rail to resist buckling in response to a longitudinal loading from one end of the rail. Effective sizes for slots have been found to be approximately one inch in width and a minimum of twelve inches (12") in length. However, for the purposes of this invention, any width and length combination that permits cables 34, 36 or 38 to pass though guardrail beam 24 may be acceptable.

Guardrail beams 24 are preferably formed from sheets of a base material such as steel alloys suitable for use as highway guardrail. Guardrail beam 24 of the present invention may be manufactured by conventional "roll form" methods using steel alloy materials associated with standard heavy gauge W-beam guardrails. Guardrail beam 24 preferably retains many of the standard dimensions associated with standard heavy gauge metal W-beam guardrails. In one embodiment, guardrail beam 24 may be designed and fabricated according to AASHTO Designation M180-00.

Guardrail beam 24 preferably includes front face 24*a*, and rear face 24*b*, disposed between top edge region 53*a* and bottom edge region 53*b*. Front face 24*a* is preferably disposed adjacent to roadway (not expressly shown). Crowns 52 are formed between top edge region 53*a* and bottom edge region 53*b*. Although the embodiment illustrated in FIGS. 1-10A has a generally W-beam shape, other shapes, including but not limited to a "Thrie-Beam," may be suitable for use within teachings of the present invention, including the embodiments illustrated in FIG. 10B.

As compared to W-beams or other conventional guardrails, wherein the rail is mounted on the post 20 so as to present a relatively low and narrow barrier area, the thrie-beam rail presents a higher and wider barrier area more effective in stopping and slowing impacting trucks or other taller vehicles. A W-beam, for example, presents a barrier which is approximately twelve inches (12") wide from top to bottom of the barrier. The top of a typical guardrail barrier may be approximately twenty-seven inches from the ground when mounted. A thrie-beam often has a width between edge regions 53*a* and 53*b* of approximately twenty inches (20"). When mounted on support posts such as posts 20, the top of a thrie-beam may be about thirty-one or thirty-two inches from the ground. In addition, thrie-beam guardrail configurations often include a pair of valley 54 due to the additional crown 52. Thus, cables 34, 36 or 38 may be used with either valley as determined by the roadway and highway obstructions.

The total length of a typical guardrail beam 24 measured from leading edge to trailing edge is approximately twenty-five (25) feet. Other lengths of guardrail section including, but not limited to one-half lengths, or twelve and one-half foot members, may also be provided within teachings of the present invention. Edge regions 53*a* and 53*b* and the overall geometry of guardrail beam 24 allow combining guardrail beam 24 and conventional or standard W-beam guardrails within a single guardrail system, to maintain the benefits described herein. Accordingly, guardrail beams 24 may be incorporated into existing guardrail systems as needed, and an entire retrofit of any particular guardrail system is not required in order to recognize the benefits of the present invention. In fact, the overall geometry of guardrail beam 24 is configured to accommodate a close fit between conventional or standard W-beam guardrails.

Guardrail beam 24, formed in accordance with teachings of the present invention, provides improved safety performance and protection of the general public. Recently, increased interest in the need for more stringent safety requirements has culminated in the issuance of the National Cooperative Highway Research Program Report 350 (NCHRP 350). The performance standards of NCHRP 350 require all new safety hardware to be tested with larger vehicles than required by previous standards. NCHRP 350 evaluates all safety hardware within three areas: structural adequacy, occupant risk, and vehicle trajectory. Each area has corresponding evaluation criteria. The Federal Highway Administration (FHWA) officially adopted these new performance standards and has ruled that all safety hardware installed after Aug. of 1998 will be required to meet the new standards.

During a rail face impact between a vehicle and guardrail beam 24, block out 22 may provide a lateral offset between the respective post and guardrail beam 24. The distance and direction of the lateral offsets is selected to prevent the wheels (not shown) of a vehicle from striking one or more posts during a rail face impact.

Figure 3A:
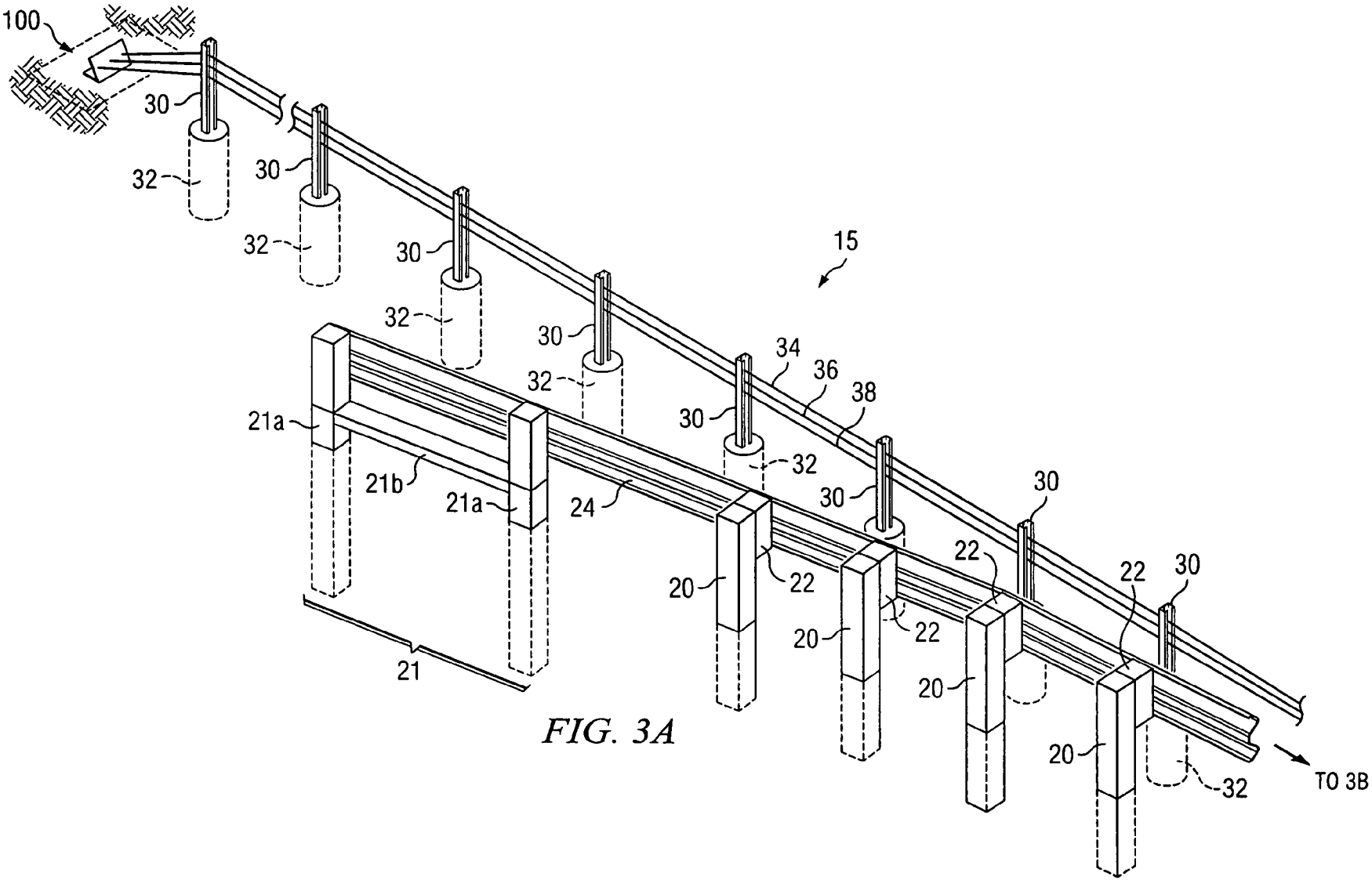
FIGS. 3A and 3B are perspective views with portions broken away of one embodiment of a combined guardrail and cable safety system incorporating teachings of the present invention.
Figure 3B:
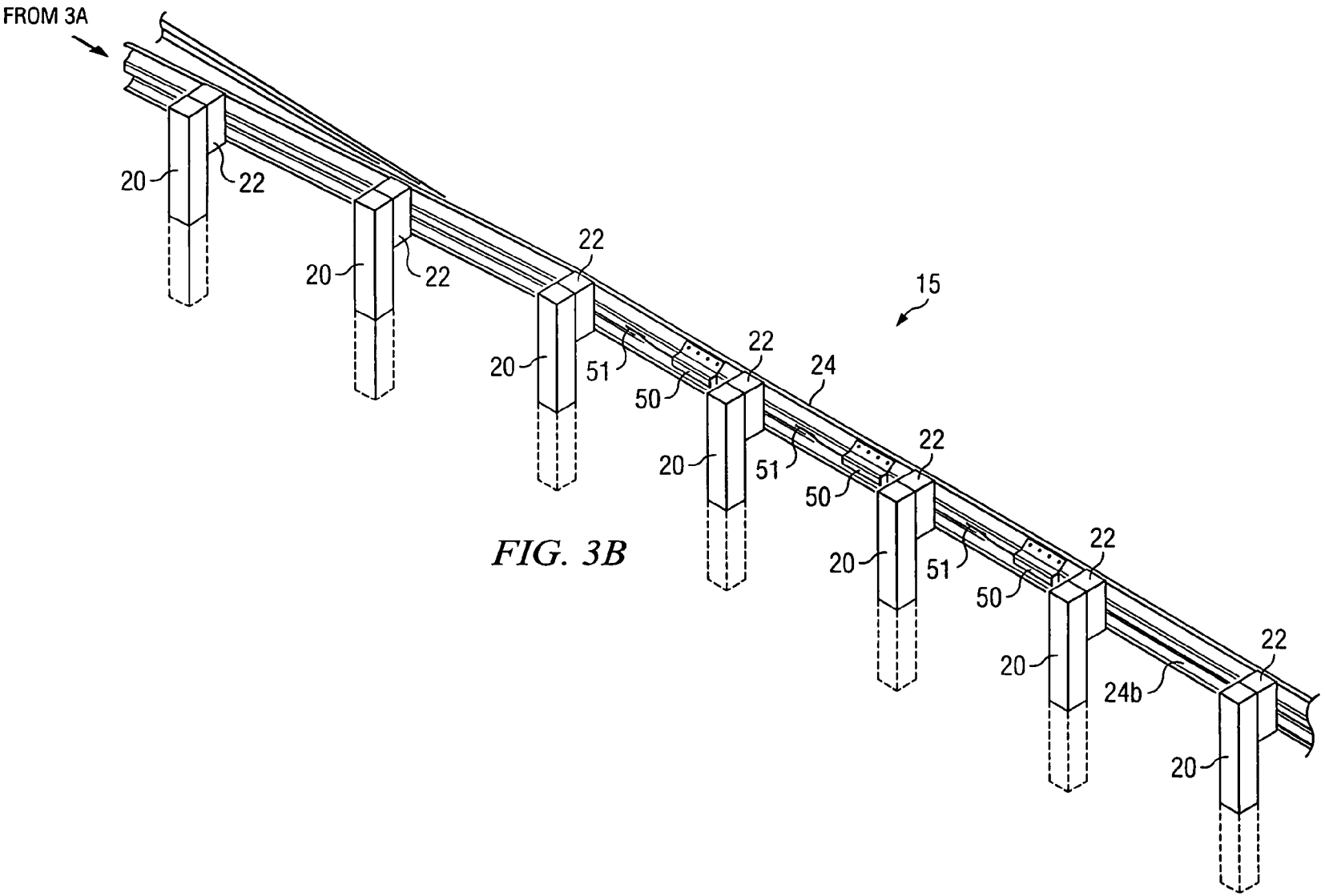

Various types of guardrail beams, cables and/or wire ropes may be satisfactorily used to form a combined guardrail and cable safety system 15 in accordance with teachings of the present invention. Cables 34, 36 and 38, as shown in FIGS. 3A and 3B, may be substantially identical. However, for some applications each cable of safety system 15 formed in accordance with teachings of the present invention may have different characteristics. Generally, cable safety systems are described as flexible, substantially maintenance free systems with designed low deflection of cables 34, 36 and 38 during a vehicle impact. In some embodiments of the present invention, cable safety systems may minimize damage during a vehicle impact with posts 30 and/or cables 34, 36 and 38.

Guardrail end terminal assembly 21 is provided to minimize or eliminate the potential for a serious accident from a head on collision with the end of guardrail safety system facing oncoming traffic. As such, the present invention may be used with either energy absorbing end terminals or non-energy absorbing end terminals. In some embodiments, guardrail end terminal assembly 21 preferably includes kinetic energy absorbing assembly (not expressly shown) which may prevent guardrail safety system from piercing the vehicle and passenger compartment or causing a vehicle to either roll over or vault guardrail safety system. See FIG. 3B. In the event of a collision between a vehicle and the end of guardrail safety system, kinetic energy absorbing assembly dissipates the impact energy of the vehicle without creating an unduly dangerous condition.

Guardrail end terminal assembly 21 preferably includes post 21 connected by cross member 21*b*. Post 21*a* and cross member 21*b* are typically made from wood or other suitable types of breakaway material. The types of material which may be satisfactorily used to manufacture posts with desired strength and/or breakaway characteristics appropriate for the specific guardrail system, location of each post and roadside hazard include but are not limited to wood, steel, composite materials and various types of plastics.

Various guardrail designs and end terminal assemblies have been developed to minimize consequences resulting from impact between a vehicle and the end of a guardrail. These designs include tapering the end of the guardrail into the ground to eliminate potential contact with the end of the guardrail. Other types of end terminal assemblies include breakaway cable terminals (BCT), slotted rail terminals (SRT), sequential kinking terminals (SKT), vehicle attenuating terminals (VAT), end terminal assemblies (ET), flared end terminals (FET) including flared energy absorbing terminals (FLEAT), the Sentre end treatment, and breakaway end terminals (BET).

It is desirable for guardrail end terminal assembly 21 to be usable at either end of a guardrail as a means of both attenuating a head on impact as well as providing an effective anchor for an impact along the side of the guardrail downstream from the end terminal assembly. Examples of such end terminal assemblies are shown in U.S. Pat. No. 4,928,928 entitled Guardrail Extruder Terminal, and U.S. Pat. No. 5,078,366 entitled Guardrail Extruder Terminal. Other examples include U.S. Pat. No. 5,407,298 entitled Slotted Rail Terminal, U.S. Pat. No. 5,503,495 entitled Thrie-Beam Terminal with Breakaway Post Cable Release, U.S. Pat. No. 5,547,309 entitled Thrie-Beam Terminal with Breakaway Post Cable Release, U.S. Pat. No. 6,435,761 entitled Slot Guard for Slotted Rail Terminal, U.S. Pat. No. 6,533,249 entitled Guardrail Beam with Improved Edge Region and Method of Manufacture, U.S. Pat. No. 6,554,256 entitled Highway Guardrail End Terminal Assembly, U.S. Pat. No. 6,575,434 entitled Apparatus and Methods for Strengthening Guardrail Installations, U.S. Pat. No. 6,715,735 Head Assembly for Guardrail Extruder Terminal and European Pat. No. EP 1,325,194 A1 entitled Improved Guardrail Terminals.

Figure 4A:
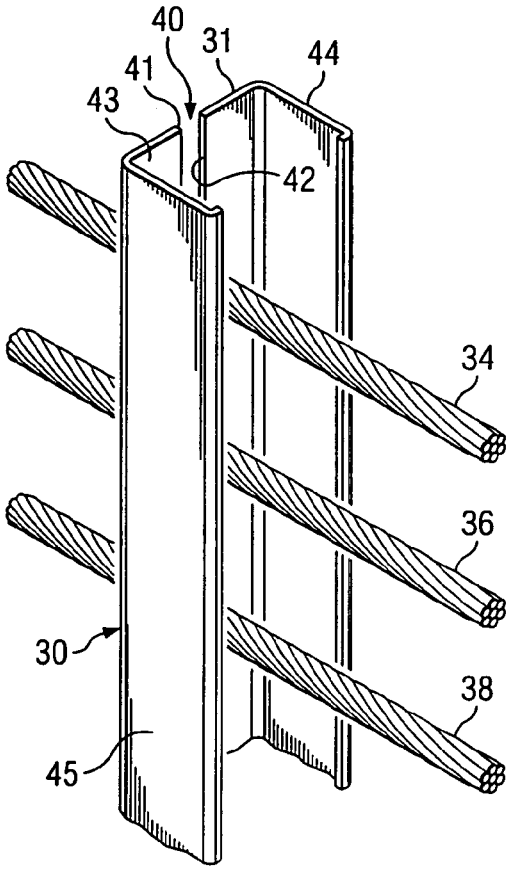
FIG. 4A is an enlarged schematic drawing showing an isometric view with portions broken away of a post and cables satisfactory for use with a combined guardrail and cable safety system incorporating teachings of the present invention.

FIG. 4A is an enlarged schematic drawing showing an isometric view with portions broken away of cable post 30 and cables 34, 36 and 38 incorporating teachings of the present invention. As shown in this embodiment of the present invention, cable post 30 includes a generally C-shaped cross section defined in part by web 43 with respective legs 44 and 45 extending therefrom.

Typically, the extreme edges of each leg 44 and 45 opposite from attached web 43 are preferably rounded or bend inward to eliminate any sharp edges being exposed. Cable post 30 generally has a "rounded" or "soft" profile. For some applications, cable post 30 may be formed using roll forming techniques.

Slot 40 is preferably formed in web 43 extending from first end 31 towards second end (are shown below in more detail). The length of slot 40 may be selected in part based on desired vertical spacing of cable 38 relative to the adjacent roadway. The length of slot 40 may also be selected to accommodate the number of cables which may be installed therein and desired vertical spacing between each cable. Slot 40 may have a generally elongated U-shaped configuration defined in part by first edge 41, second edge 42 and bottom 47 (shown below in more detail). In some embodiment, first edge 41 and second edge 42 may have a generally smooth profile and extend generally parallel with each other. Forming slot 40 within web 43 of cable post 30 eliminates requirements for bolts, hooks or other mechanical attachments to releasably secure cables 34, 36 and 38 with cable post 30.

For some applications, cable post 30 may be formed from metal sheet having a thickness of 4 millimeters, a length varying approximately from 700 millimeters to 1,600 millimeters and a width of approximately 350 millimeters. The metal sheet may weigh approximately 7.8 kilograms per meter (kg/m). For other applications, cable post 30 may be formed from a metal sheet having a thickness of 4 millimeters, a length varying approximately from 700 millimeters to 1,600 millimeters, a width of approximately 310 millimeters and a weight of less than 4.5 kg/m.

In some aspects, cable post 30 may be installed in a tube sleeve (not expressly shown) that is driven directly into the soil.

Figure 4B:
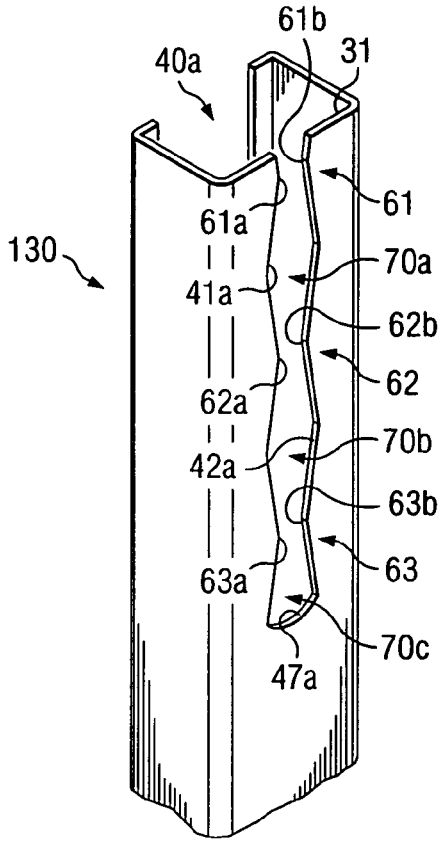
FIG. 4B is a schematic drawing in elevation with portions broken away showing another example of a cable post formed in accordance with teachings of the present invention.

One aspect of the present invention includes forming one or more restrictions within slot 40 to help retain associated cables within the respective slot when a vehicle impacts the associated safety barrier. Cable post 130 is shown in FIG. 4B retains cables 34, 36 and 38 within slot 40*a* by restrictions formed along edges 41*a* and 42*a*. As a result of the restrictions formed within slot 40*a*, cables 34, 36 and 38 will be retained within slot 40*a* when cable post 130 impacted by a vehicle and is bent at an angle from vertical, which typically causes the release of cable 34, 36 and 38 from slot 40 of cable post 30.

FIG. 4B is an enlarged schematic drawing showing another example of cable post 130 having slot 40*a* form thereon with a plurality of restrictions and/or projections formed in each edge 41*a* and 42*a*. For the embodiment of the present invention as shown in FIG. 4B the location and configurations of the restrictions formed in edges 41*a* and 42*a* are selected to correspond generally with the desired location for associated cables 34, 36 and 38.

Restrictions 61, 62 and 63 of slot 40*a* may be defined in part by respective projections 61*a*, 61*b*, 62*a*, 62*b*, 63*a*, 63*b* and bottom 47*a*. Edges 41*a* and 42*a* of slot 40*a* preferably include alternating tapered or sloping surfaces which form respective projections 61*a*, 61*b*; 62*a*, 62*b* and 63*a*, 63*b*. The same tapered or sloping surfaces also form respective enlarged openings 70*a*, 70*b* and 70*c* within slot 40*a*. The location of enlarged openings 70*a*, 70*b* and 70*c* are preferably selected to correspond with approximate desired locations for cables 34, 36 and 38. The gap or spacing formed between respective projections 61*a* and 61*b*, 62*a* and 62*b* and 63*a* and 63*b* is generally selected to be greater than the outside diameter of cables 34, 36 and 38.

Specific dimensions between the respective projections are selected to provide optimum resistance to disengagement between cables 34, 36 and 38 as cable post 130 with slot 40*a* is bent from a generally vertical position towards a horizontal position and still allow easy installation of cables 34, 36 and 38 in slot 40*a*.

Figure 5:
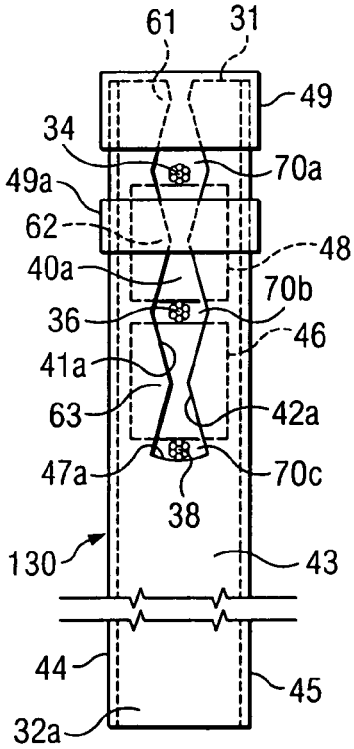
FIG. 5 is a schematic drawing in elevation with portions broken away showing another example of a post and attached cables satisfactory for use with a combined guardrail and cable safety system incorporating teachings of the present invention.

FIG. 5 is a schematic drawing in elevation with portions broken away showing one example of cable post 30 and attached cables 34, 36 and 38 incorporating teachings of the present invention. Respective cap 49 may be placed on first end 31 of each cable post 30. Retaining band or bands 49*a* may be placed on the exterior of one or more cable posts 30 to provide additional strength. Cap 49 and retaining bands 49*a* may be formed from various types of metals, elastomeric materials and/or composite materials.

For some applications, retaining band 49*a* may be formed from a relatively strong steel alloy to provide additional support to allow cable post 30 to handle forces imposed on edges 41 and 42 by cables 34, 36 and 38 during a vehicle impact with combined guardrail and cable safety system 15, cable 38 may be disposed within slot 40 resting on bottom 47 therein. Since cable post 30 has a partially closed cross section defined in part by the bend or rounded edges of legs 44 and 45, a relatively simple first spacer 46 may be inserted or dropped into cable post 30 to rest on cable 38 opposite bottom 47. Spacer 46 may be a block having a generally rectangular configuration with a thickness satisfactory for insertion within the cross section of cable post 30. The height of spacer 46 is preferably selected to correspond with desired vertical spacing between cables 38 and 36.

Cable 36 may be inserted into slot 40 after spacer 46 has been disposed onto cable 38. Spacer 48 may then be installed within slot 40 with one end resting on cable 36 opposite from the spacer 46. The height of spacer block 48 is preferably selected to correspond with desired vertical spacing between cables 36 and 34. Spacer 48 may be a block having a generally rectangular configuration with a thickness satisfactory for insertion within the cross section of cable post 30.

Cable 34 may then be installed within slot 40 resting on spacer 48 opposite from cable 36. One or more retaining bands 49*a* may be secured with the exterior of cable post 30 between cables 34 and 36 and/or cables 36 and 38. Cap 49 may be placed over first end 31 of cable post 30 after installation of cables 34, 36 and 38 and spacers 46 and 48.

For some applications, second end 32*a* of each cable post 30 may be installed in concrete foundation 32 or footing (not expressly shown). In other applications, a flip plate (not expressly shown) may be attached to second end 32*a* of each cable post 30 for use in bolting or otherwise securely attaching cable post 30 with a larger flip plate (not expressly shown) that has been cast into a concrete foundation or similar structure adjacent to a roadway. Alternatively, second end 32*a* may be inserted directly into the ground. One or more soil plates (not expressly shown) may be attached to cable post 30 proximate respective second ends 32*a* when cable post 30 are installed directly into the ground adjacent to a roadway.

In other embodiments of the present invention, cable safety system may be formed using a low-tensioned cable system such as cable systems including I-beam posts and hook bolts (not expressly shown).

FIG. 6 is a schematic drawing taken along lines 6-6 of FIG. 2. In one embodiment, post 20 is coupled to block out 22 to support guardrail beam 24 using bolt 23. Cables 34, 36 and 38 are typically run within valley 54 of guardrail beam 24 facing the traffic flow. As illustrated, two guardrail beams 24 may be joined with bolts 90 and nuts 92. Cables 34, 36 and 38 extend from cable safety system to run along the face of guardrail beam 24 and may assist in adding additional lateral support to guardrail beam. Typically, crowns 52 formed on either side of cables 34, 36 and 38 restrict movement of cables 34, 36 and 38 along the face of guardrail beam 24. Even with cables 34, 36 and 38 traversing the length of guardrail beam 24 access to bolts 90 and nuts 92 is permitted for repair or replacement of individual components.

FIG. 7 is a schematic drawing taken along lines 7-7 of FIG. 2. Cables 36 and 38 are shown passing on the direction of traffic flow. As shown, cable 36 extending within valley 54 passes through slot 51 of guardrail beam 24 and extends towards cable bracket 80 of cable bracket assembly 50 formed along the inside of guardrail beam 24 away on the opposite side of the flow of traffic. Because cables 34, 36 and 38 have a certain amount of play within valley 54, cables 34, 36 and 38 can be adjusted to allow for individual cables to be placed over slot 51 such that any one cable may pass through guardrail beam 24. As illustrated, cable 38 is able to continue along the face of guardrail beam 24 within valley 54.

FIG. 8 is a schematic drawing taken along lines 8-8 of FIG. 2. Generally, cables 34, 36 and 38 pass though guardrail beam 24 at different locations and as such each cable is terminated into cable bracket assembly 50. As illustrated, cable 38 passing along the face of guardrail beam 24 along the flow of traffic is shown to pass through guardrail beam 24 to be attached via cable bracket assembly 50. As illustrated in FIGS. 1, 2 and 3A and 3B, cables 34 and 36 may be attached along other sections of combined guardrail and cable safety system 15 such that cable 38 is the remaining cable to attached to guardrail beam 24.

Figure 9:
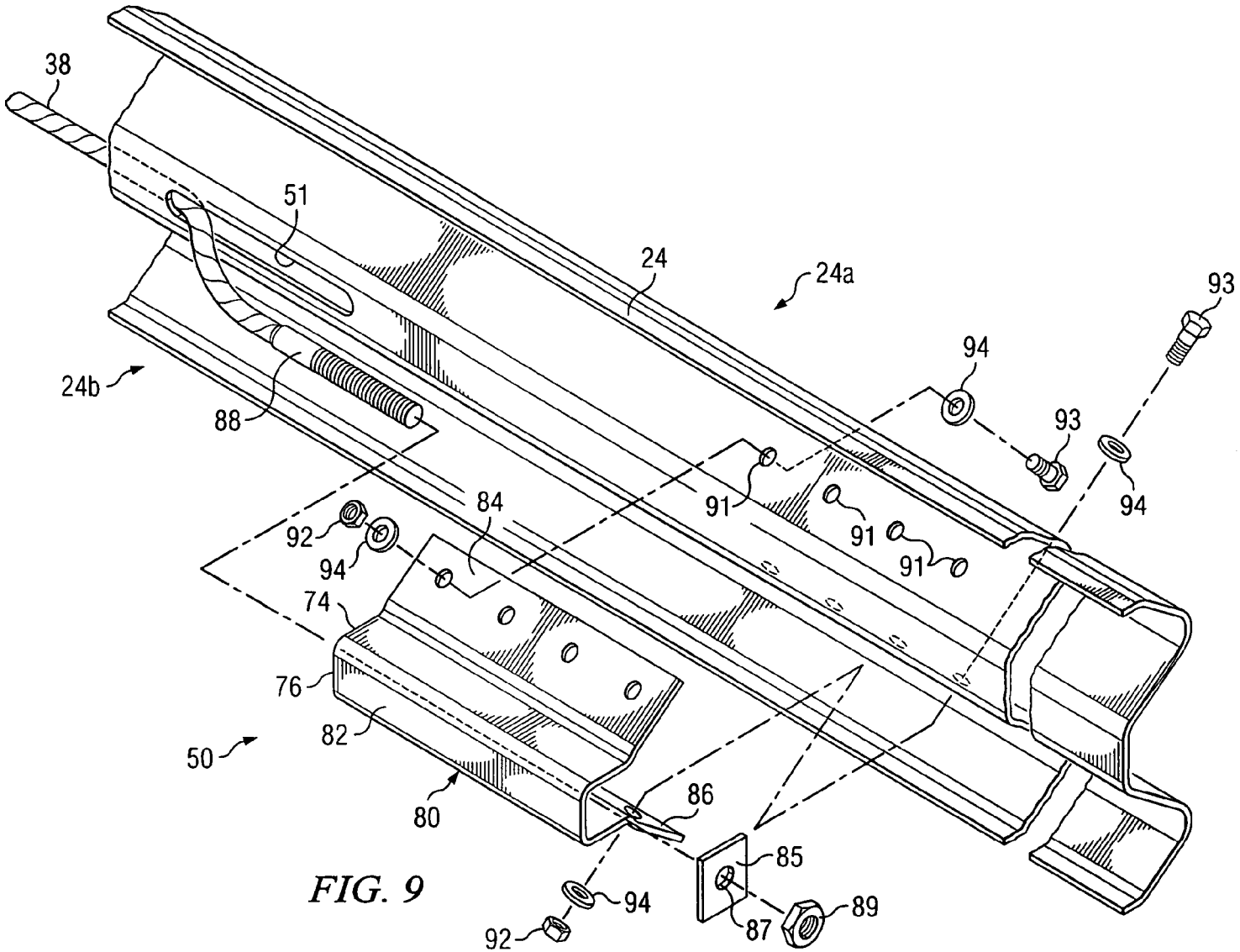
FIG. 9 is an enlarged schematic drawing with portions broken away showing an isometric view of an example embodiment of a combined guardrail and cable safety system with a cable anchor bracket incorporating teachings of the present invention.

FIG. 9 is an enlarged schematic drawing showing an isometric view of an example embodiment with portions broken away of combined guardrail and cable safety system 15 and cable anchor bracket assembly 50 incorporating teachings of the present invention. As illustrated, end of cable 38 may inserted through elongated opening or slot 51 formed in guardrail beam 24 for attachment to cable anchor bracket assembly 50. Cable anchor bracket assembly 50 preferably includes cable anchor bracket 80 that is attached to the backside of guardrail beam 24. Cable anchor bracket 80 preferably includes elongated member 82 having a first side 74 and second side 76 which cooperate with each other to define cable receiving channel there between having a generally open U-shaped cross section that is bordered by the backside of guardrail beam 24 that is enclosed by guardrail beam 24. Cable anchor bracket 80 preferably includes first flange 84 that extends generally from first side 74 along the direction of guardrail beam 24. Second side 76 generally has second flange 86 extending therefrom to attach to a second portion of guardrail beam 24.

First flange 84 and second flange 86 are preferably used to couple cable anchor bracket 80 to guardrail beam 24 via bolts 93 extending through guardrail beam 24 and secured with washers 94 and nuts 92. Although the present embodiment is illustrated with two washers 94, the present invention may be practiced with more or less number of washers including but not limited to various types of washers such as a flat washer or a lock washer. In the some embodiments of the present invention, bolts 93 are hex bolts. However, bolts 93 may include a variety of fastening devices such as carriage bolts, rivets, screws or any other type of connector.

Generally, bolts 93 are arranged longitudinally along guardrail beam 24 to mount and couple cable bracket assembly 80 thereby forming a generally rectangular cross section able to receive end of cable 38 therethrough. In one application, cable anchor bracket 80 may be fabricated from a single of piece of generally rectangular sheet metal (not shown) by forming a first longitudinal bend between first flange 84 and first side 74. Second, third and fourth bends are expressly formed between sides 74 and 82 and between side 82 and second side 76 and lastly, between side 76 and second flange 86. The resulting elongated shape, namely cable anchor bracket 80, forms a receiving shape that is generally rectangular and open on both longitudinal ends. The first longitudinal end is able to receive end of cable 38 to be readily disposed therein.

The end of cable 38 extends into cable bracket assembly 80 that is mounted onto guardrail beam 24 and feeds through opening 87 of plate 85 for attachment to cable anchor bracket 80. Threaded cable termination 88 may be provided on end portion of cable 38 to allow for connection to cable bracket assembly 50. Once extended through opening 78, nut 89 may be used in conjunction with threaded cable termination 88 and plate 85 to fasten cable 38 to cable anchor bracket 80. In some embodiments, cable tension of cable 38 may be adjusted by turning nut 89 against plate 85. Cable anchor bracket assembly 50 and the respective attachments and cables of the present invention meet National Highway Safety requirements and allow reducing the manufacturing costs of the associated connections and mountings as compared with other end terminal assemblies.

Typically, the guardrail beam 24 includes a typical deep W-beam 10 gauge type guardrail beam. Other types of guardrails both folded and non folded may be satisfactorily used with the present invention. For example, a thrie-beam configuration (as described above) and other types of guardrail beams may be satisfactorily used with the present invention.

Figure 10A:
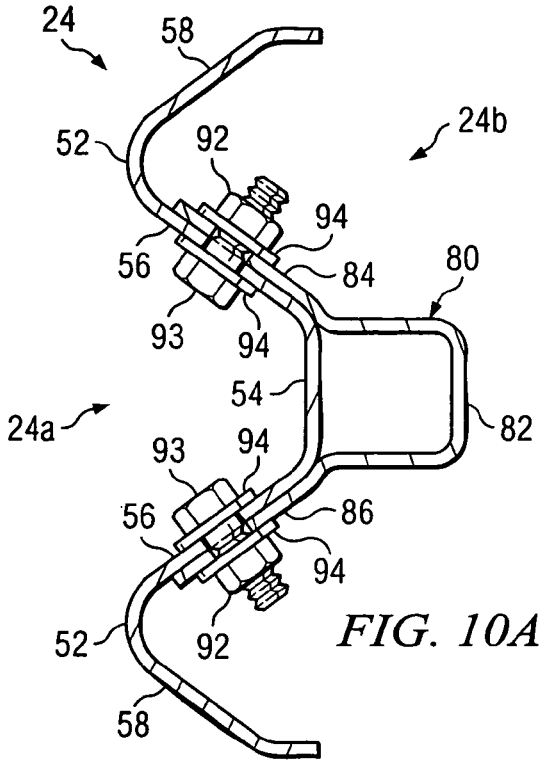
FIG. 10A is a schematic drawing in section of a cable anchor bracket incorporating teachings of the present invention bolted to a beam.
Figure 10B:
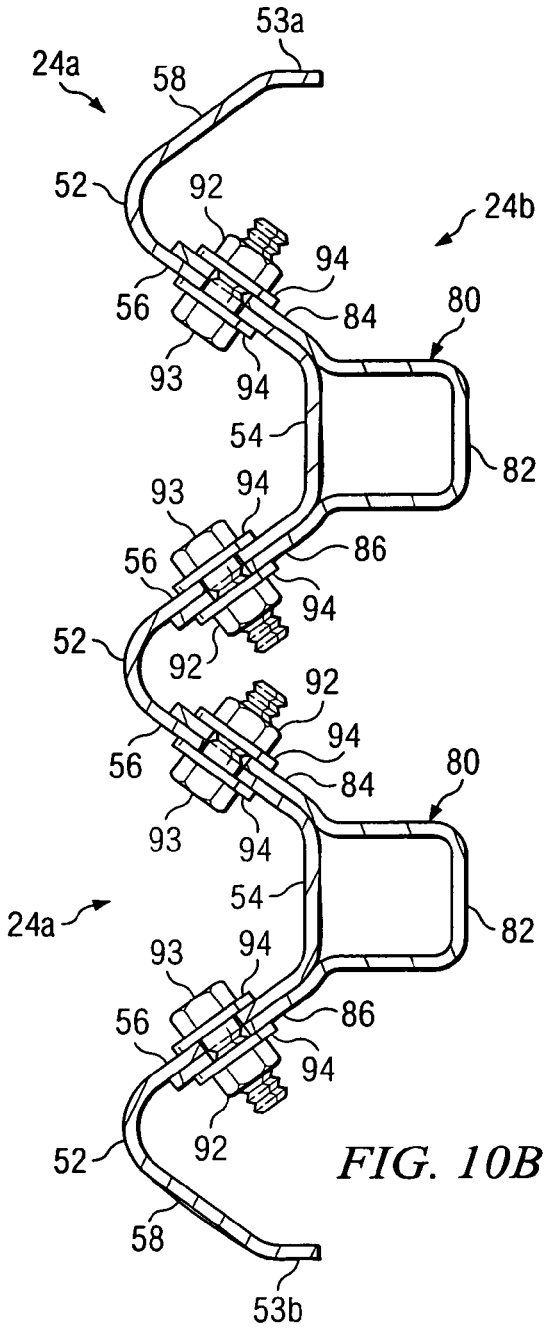
FIG. 10B is a schematic drawing in section of an example embodiment of a thrie-beam guardrail.

FIG. 10A illustrates a cross-sectional view of the cable anchor bracket 80 bolted to a guardrail beam 24 incorporating teachings of the present invention. For one application, cable anchor bracket 80 forms a generally rectangular cross-section to allow for the insertion of end of cable 34, 36 and 38 having a end terminal connections such as threaded cable termination 88 mounted on the end of the cable for attaching the cable to the assembly.

As shown, first flange 84 extends along the same direction and same angle as web portion 56 of guardrail beam 24 to allow bolts 93 to extend therethrough and couple using bolt 92. Similarly, second flange 86 extends along the same angle as web portion 56 of guardrail beam 24 allowing for coupling using bolt 93 with washers 94 and nut 92. Depending on design criteria, cable anchor bracket 80 may include additional more or less mounting bolt connections.

Figure 11:
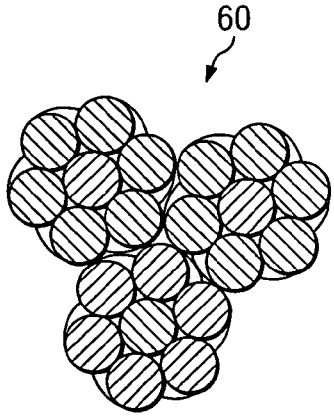
FIG. 11 is a schematic drawing in section showing one example of a cable satisfactory for use in forming a cable safety system.

FIG. 11 is a schematic drawing in section showing one example of a cable satisfactory for use in forming a cable safety system in accordance with teachings of the present invention. For some applications cables 34, 36 and 38 may be formed from seven strand wire rope. Other types of wire ropes and cables may also be used. A plurality of cables 34, 36 and 38 may be attached to support posts 30 in accordance with teachings of the present invention. Support posts 30 generally maintain associated cables 34, 36 and 38 in substantially horizontal positions extending along an edge of the roadway. Support posts 30 often allow relative quick and easy repair of combined guardrail and cable safety systems 15 after a vehicle impact.

Cable safety systems are generally relatively narrow as compared to conventional W-beam and thrie beam guardrail systems. The length of cables 34, 36 and 38 may extend up to 3,000 meters from below-ground anchor 100. For other applications the length of cable 34, 36 and 38 may exceed 3,000 meters without an intermediate anchorage. Cable posts 30 maintain desired vertical spacing between cables 34, 36 and 38 and desired vertical spacing of each cable relative to the ground. Cable safety system including cable posts 30 formed in accordance with teachings of the present invention may be designed in accordance with teachings of the present invention to meet or exceed the criteria of NCHRP Report 350 Test Level 3 requirements.

Cables 34, 36 and 38 are typically disposed in slot 40 of each cable post 30. Generally, each cable 34, 36 and 38 are disposed at different heights relative to the ground and relative to each other. Varying the vertical spacing between cables 34, 36 and 38 often provides a much wider lateral catch area for vehicles impacting with combined guardrail and cable safety system 15. The vertical spacing between cables 34, 36 and 38 may be selected to satisfactorily contain both pickups and, to some extent, even larger vehicles with a relatively high center of gravity, as well as vehicles with a low front profile and low center of gravity.

Cables 34, 36 and 38 may be prefabricated in approximately three hundred (300) meter lengths with desired fittings attached with opposite ends of each cables 34, 36 and 38. Tailor made cables 34, 36 and 38 may then be delivered to a desired location for installation adjacent to a roadway.

Alternatively, cables 34, 36 and 38 may be formed from a single cable stored on a large drum (not expressly shown). Cables stored on drums may often exceed three thousand (3,000) meters in length. Cables 34, 36 and 38 may be cut in desired lengths from the cable stored on the drum. Appropriate fittings (not expressly shown) may be swaged or otherwise attached with opposite ends of the respective cable 34, 36 and 38 at an onsite location. In one embodiment, cables 34, 36 and 38 may be installed between below ground anchors 100 and cable anchor bracket assembly 50 with approximately twenty thousand Newtons of tension over a length of approximately three thousand (3,000) meters.

Cable 60 as shown in FIG. 11 may be formed from three groups of seven strand wire rope. Cable 60 may be used in forming combined guardrail and cable safety system 15. Cable 60 may have a modulus of elasticity of approximately 8,300 kilograms (kg) per square millimeter (mm). The diameter of each strand used to form cable 60 may be approximately three (3) mm. The diameter of cable 60 may be approximately nineteen (19) mm. Cable 60 may be prestretched to approximately fifty percent (50%) of designed or rated breaking strength. One or more cables 60 may be used to replace cables 34, 36, and/or 38 of combined guardrail and cable safety system 15.

Figure 12:
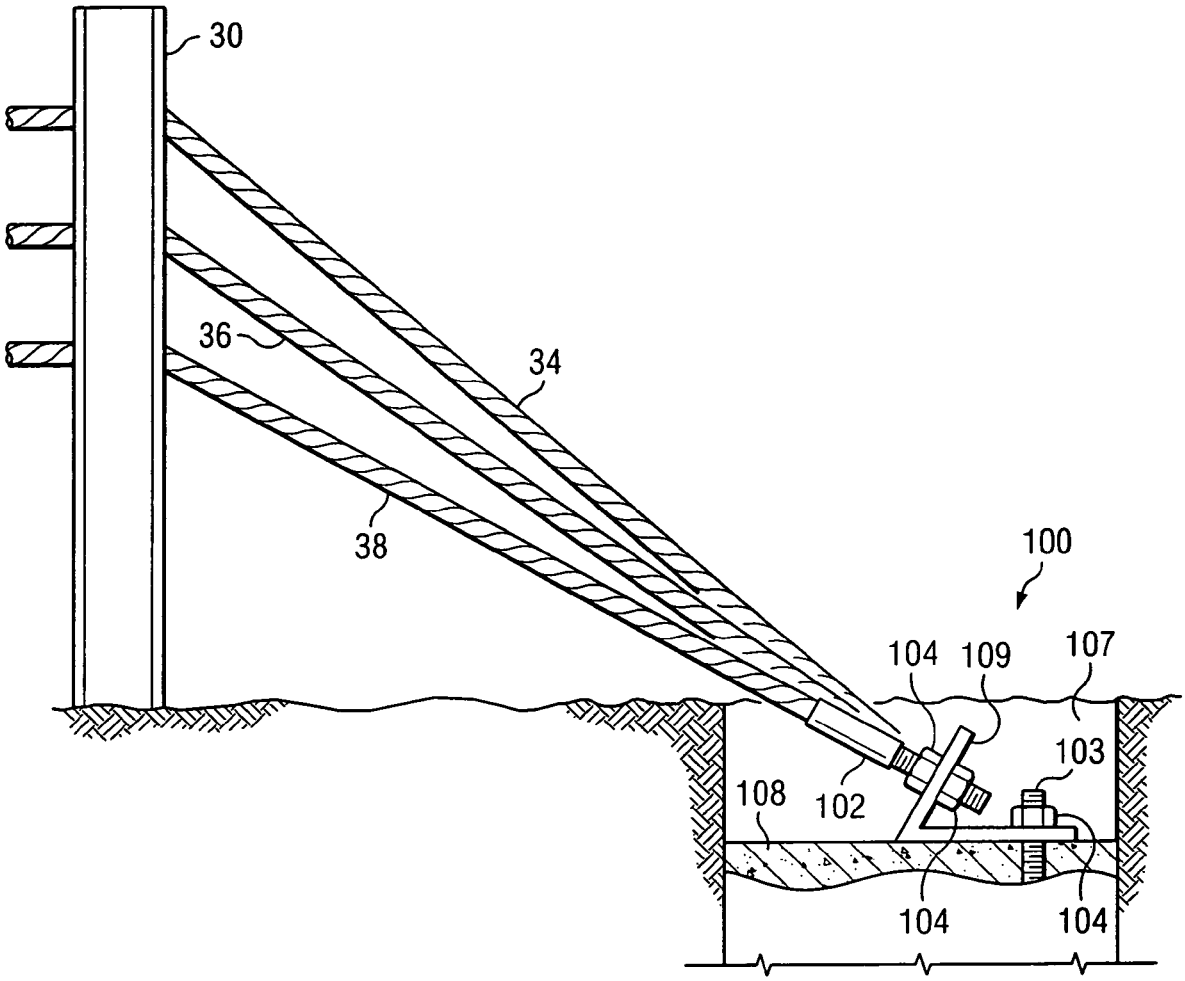
FIG. 12 is a schematic drawing in section and in elevation with portions broken away of a below-ground cable anchor assembly satisfactory for use with the cable safety system of FIG. 3A.

FIG. 12 shows one example of below-ground anchor 100 which may be satisfactorily used with a combined guardrail and cable safety system incorporating teachings of the present invention. Generally, below-ground anchor 100 is set approximately ten feet from cable post 30. Respective holes 107 may be formed in the ground at desired locations for below-ground anchor 100. A portion of each hole 107 may be filled with concrete foundation 108.

Anchor plate 109 may be securely engaged with concrete foundation 108 using various types of mechanical fasteners, including, but not limited to, a plurality of bolts, such as concrete anchor bolts 103, and nuts 104. Anchor plate 109 may be formed at an appropriate angle to accommodate the design of combined guardrail and cable safety system 15. Also multiple slots and/or openings (not expressly shown) may be formed in anchor plate 109 to receive respective threaded cable termination 102 extending from each cable 34, 36 and 38.

For the embodiment of the present invention as shown in FIG. 12, threaded cable termination 102 of cable 32 is shown engaged with anchor plate 109. Threaded cable termination 102 may be use nuts 104 to coupled on both sides of anchor plate 109 to maintain a fixed position in relation to anchor plate 109. Various types of anchor assemblies and cable end fittings such as threaded cable termination 102 may be satisfactorily used with a combined guardrail and cable safety system incorporating teachings of the present invention. The present invention is not limited to below-ground anchor 100 or threaded cable termination 102 as shown in FIG. 12.

Figure 13:
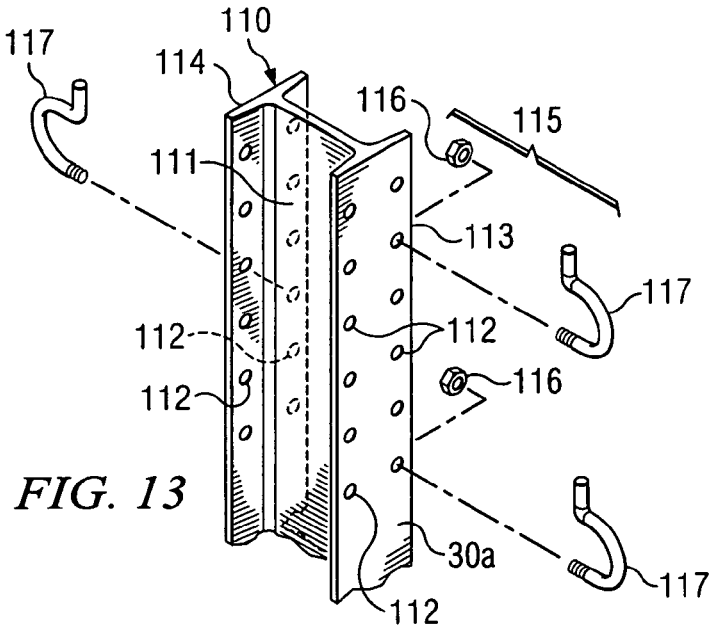
FIG. 13 is an enlarged schematic drawing showing an isometric view with portions broken away of one embodiment of a cable post satisfactory for use with a combined guardrail and cable safety system incorporating teachings of the present invention.

FIG. 13 is an enlarged schematic drawing showing an isometric view with portions broken away of one embodiment of cable post 30*a* satisfactory for use with a combined guardrail and cable safety system incorporating teachings of the present invention. Cable post 30*a* are generally interchangeable with cable post 30. Cable posts 30*a* may be associated with various types of mounting structures such as a foundation tube such as concrete tube 32 or a soil plate (not expressly shown) for direct placement in the ground.

As shown in this embodiment, cable post 30*a* includes a generally I-beam cross section defined in part by web 111. Connecting flanges 113 and 114 are formed on opposite ends of web 111 such that flanges 113 and 114 generally extend perpendicular to web 111. Typically, flanges 113 and 114 are arranged substantially parallel to each other allowing cables 34, 36 and 38 to couple to flanges 113 and/or 114 at respective heights from the ground level. As such, flanges 113 and 114 are generally mounted and/or installed parallel to a highway or roadway (not expressly shown).

In order to maintain or alter the position of cables 34, 36 and 38, with respect to ground level, cable post 30*a* may further include cable retainers 115. Typically, each cable retainer 115 is associated with a respective cable 34, 36 and 38 to maintain its position relative to ground level on cable post 30*a*. Cable retainers 115 may include a variety of attachment retainers such as u-bolt clamps, cable clamps or other mechanical devices that may retain cable 34, 36 or 38 to cable post 30*a*. In one embodiment, cable retainer 115 includes cable lock bolt 117 and nut 116 that fasten respective cables 34, 36 and 38 at associated openings 112.

Openings 112 are typically formed in cable post 30*a* along the edges of flanges 113 and 114. As shown in the embodiment, two openings 112 are formed to receive respective ends of cable lock bolt 117 such that nut 116 attaches to at least one end of cable lock bolt 117 to couple one of cables 34, 36 or 38 to cable post 30*a*. Openings 112 are generally formed in columnar groups such that cable height may be varied based on the selection of different openings 112.

For example, six openings 112 may be formed in a substantially columnar group extending from top 110 of cable post 30*a* toward ground level along one edge of cable post 30*a*. By associating cable retainer 115 with two openings 112 near top 110, cable 34 may couple to cable post 30*a* at a respective position from ground level. Alternatively, cable retainer 115 may be associated with lower openings 112 for coupling cables 36 or 38 to a position closer to ground level.

Figure 14:
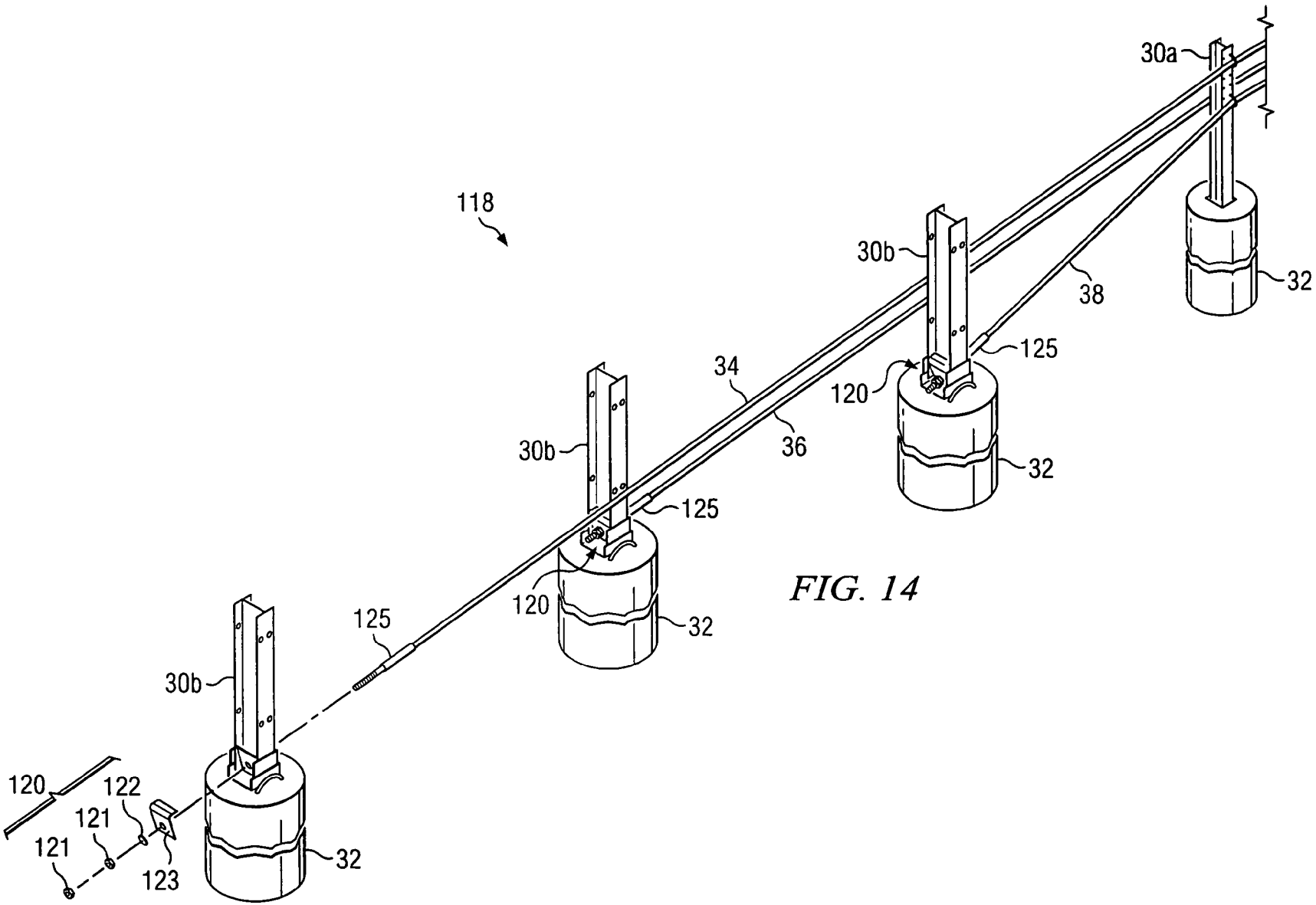
FIG. 14 is a schematic drawing in section and in elevation with portions broken away of a cable terminal assembly satisfactory for use with the cable safety system of FIG. 3A.

FIG. 14 shows one example of cable terminal assembly 118, which may be satisfactorily used with a combined guardrail and cable safety system incorporating teachings of the present invention. In addition to below-ground anchor 100, cable terminal assembly 118 may also be used to terminate a cable safety system.

As shown in the example embodiment, cable posts 30*b* may couple to foundation tubes such as concrete tubes 32 such that cable posts 30*b* may be formed as breakaway posts.

Cables 34, 36 and 38 attached to respective cable posts 30*b* and are secured with cable bracket post assemblies 120. Each cable post 30*b* is associated with one cable bracket post assembly 120 that secures a respective cable. For example, in a cable safety system having three cables, cable terminal assembly 118 includes three cable post 30*b* each used to secure one of the three cables.

Each cable 34, 36 and 38 may include a cable termination such as threaded cable termination 125 that permits cable 34, 36 and 38 to couple to their respective cable posts 30*b*. Generally, threaded cable termination 125 of each cable extends through an slot or opening (not expressly shown) in cable post 30*b* allowing for connection to cable bracket post assembly 120. Cable bracket post assembly 120 typically includes bracket 123, washer 122 and nuts 121.

Although the present invention and its advantages have been described in detail, it should be understood that various changes, substitutions and alternations can be made herein without departing from the spirit and scope of the invention as defined by the following claims.

What is claimed is:

1. A combined guardrail safety system and cable safety system, comprising:

the guardrail safety system having a plurality of guardrail posts extending along a roadway;

each guardrail post operably coupled to a longitudinally corrugated guardrail beam having crowns and a valley between the crowns;

elongated slots disposed in and extending longitudinally along the guardrail beam;

the cable safety system having a plurality of cable posts extending along the roadway;

at least two cables supported by the cable posts;

the cables extending from the cable safety system to the guardrail safety system to form a flexible transition junction between the cable safety system and the guardrail safety system;

a portion of each cable extending through one of the slots formed in the guardrail beam and attached to the guardrail beam;

one end of each cable attached to a cable terminal assembly; and the cable terminal assembly disposed longitudinally from the flexible transition junction formed between the cable safety system and the guardrail safety system.

2. The combined guardrail safety system and cable safety system of claim 1, wherein at least one of the cables comprises a seven strand wire rope.

3. The combined guardrail safety system and cable safety system of claim 1, further comprising at least one of the cables constructed in preformed lengths prior to installation.

4. The combined guardrail and cable safety system of claim 1, wherein the guardrail beams comprised at least one W-beam guardrail.

5. The combined guardrail and cable safety system of claim 1 wherein the guardrail beams comprise at least one thrie-beam guardrail.

6. The combined guardrail and cable safety system of claim 1, further comprising a below-ground anchor operable to be secured with one end of each of the at least two cables.

7. The combined guardrail and cable safety system of claim 1, further comprising a cable terminal assembly operable to secure one end of the at least two cables.

8. A combined guardrail safety system and cable safety system, comprising:

the guardrail safety system having a plurality of guardrail posts extending along a roadway;

each guardrail post operably coupled to a longitudinally corrugated guardrail beam having crowns and a valley between the crowns;

elongated slots disposed in and extending longitudinally along the guardrail beam;

the cable safety system having a plurality of cable posts extending along the roadway;

at least two cables supported by the cable posts;

the cables extending from the cable safety system to the guardrail safety system;

a portion of each cable extending through one of the slots formed in the guardrail beam and attached to the guardrail beam;

one end of each cable attached to a below-ground anchor disposed longitudinally from the guardrail safety system; and each cable extending longitudinally from the below-ground anchor alone the plurality of cable posts to the guardrail safety system.

9. The combined guardrail and cable safety system of claim 8, wherein at least one of the cables comprises a seven strand wire rope.

10. The combined guardrail and cable safety system of claim 8, further comprising the cables constructed in preformed lengths prior to installation.

* * * * *